US010260185B2

(12) United States Patent
McMaster et al.

(10) Patent No.: US 10,260,185 B2
(45) Date of Patent: Apr. 16, 2019

(54) ANTI-PUCKER APPARATUS

(71) Applicant: SEAMFLAT LTD, Stirling (GB)

(72) Inventors: Kenny McMaster, Stirling (GB); Walter Wheater, Stirling (GB)

(73) Assignee: SEAMFLAT LTD, Stirling (GB)

( * ) Notice: Subject to any disclaimer, the term of this patent is extended or adjusted under 35 U.S.C. 154(b) by 37 days.

(21) Appl. No.: 15/497,966

(22) Filed: Apr. 26, 2017

(65) Prior Publication Data

US 2018/0155860 A1 Jun. 7, 2018

(30) Foreign Application Priority Data

Dec. 6, 2016 (GB) ..... 1620725.0
Apr. 25, 2017 (GB) ..... 1706564.0

(51) Int. Cl.
*D05B 35/00* (2006.01)
*D05B 27/10* (2006.01)

(52) U.S. Cl.
CPC ..... *D05B 35/00* (2013.01); *D05B 27/10* (2013.01); *D05D 2209/14* (2013.01)

(58) Field of Classification Search
CPC ..... D05B 27/06; D05B 27/10–27/16; D05B 1/12; D05B 35/00; D05B 35/02; D05B 35/08; D05B 55/06; D05B 61/00; D05B 73/00; D05B 77/00; D05D 2209/14
See application file for complete search history.

(56) References Cited

U.S. PATENT DOCUMENTS 789,220 A 5/1905 Krag
919,706 A * 4/1909 Eichorn
2,879,730 A * 3/1959 Smith ..... D05C 15/22 112/80.5
3,074,362 A * 1/1963 Broadrick ..... D05C 15/00 112/80.5
3,130,696 A * 4/1964 Ainslie ..... D05B 81/00 112/154
3,194,195 A * 7/1965 Kremer ..... D05B 81/00 112/154
4,473,019 A * 9/1984 Hanyu ..... D05B 29/06 112/151

(Continued)

FOREIGN PATENT DOCUMENTS

DE 19913607 A1 * 3/1930
EP 0372034 A1 2/1989

(Continued)

*Primary Examiner* — Ismael Izaguirre
(74) *Attorney, Agent, or Firm* — Cherskov Flaynik & Gurda, LLC

(57) ABSTRACT

An anti-puckering apparatus for forming, on a work piece, a line of stitching substantially free from puckering is disclosed. The apparatus includes a removable base which is added to a sewing machine bed surface proximate to a needle and a stitch formation zone. The apparatus also includes a carrier mounted on, and moveable relative to, the base and an endless row of flexible filamentary elements carried by the carrier. The carrier progressively moves subsets of filamentary elements into and out of a stitch formation zone during the formation of a line of stitching. The filamentary elements are presented across a stitch formation zone in advance of an intended line of stitching at an oblique angle relative to a sewing machine bed surface.

10 Claims, 6 Drawing Sheets

(56) References Cited

U.S. PATENT DOCUMENTS

| | | | |
|---|---|---|---|
| 4,998,492 | A | 3/1991 | Aitken |
| 2004/0060494 | A1 | 4/2004 | Martelli |

FOREIGN PATENT DOCUMENTS

| | | | | |
|---|---|---|---|---|
| GB | 326746 | A | * | 3/1930 |
| GB | 789 220 | | | 1/1958 |
| JP | 08155165 | | | 6/1996 |
| JP | 08294592 | A | | 11/1996 |
| JP | 08309058 | A | | 11/1996 |
| JP | 09038365 | | | 2/1997 |
| JP | H09 66180 | A | | 3/1997 |
| JP | H10 71285 | A | | 3/1998 |

* cited by examiner

ANTI-PUCKER APPARATUS

PRIORITY

The present application claims the benefit of priority to U.K. Patent Application No. 1620725.0, which was filed on Dec. 6, 2016; and to U.K. Patent Application No. 1706564.0, which was filed on Apr. 25, 2017, both pending as of the time of filing the present application, the contents of which are hereby incorporated by reference.

DESCRIPTION

Technical Field

The invention relates to apparatus for reducing or eliminating seam pucker between layers of material fed into a stitch formation zone on industrial or domestic sewing machines. Particularly, though not exclusively, the apparatus comprises a disc or wheel presenting downwardly inclined filaments across a stitch formation zone above layers of material to be stitched.

Background

Seam puckering is a commonly associated with the sewing of fine seams and has numerous possible contributing factors. For example, one or more of the following issues may have a causal effect: the structure or density of the material(s) being sewn; the thread and needle size relative to the material(s) being sewn; thread tension; technical matters with the sewing machine such as the accuracy of the fabric feeding mechanism; and human factors such as an individual's sewing technique. Aside from these issues, it is known that thread quality is important. For example, seam tension pucker can be eliminated, or at least significantly reduced, by selecting higher quality sewing threads exhibiting low shrinkage and controlled elongation characteristics. However, higher quality threads such as core spun threads are of course more expensive and may not always be a viable option.

Attempts have been made in the past to incorporate a mechanical solution within sewing machines aimed at eliminating or reducing seam pucker. Typically, this has involved connecting a rigid finger element to the machine mechanism which automatically reciprocates in a synchronised fashion into and out of a stitch formation zone as stitches are formed. However, such an arrangement is mechanically complex and must either be integrated within a sewing at the time of manufacture, or retrofitted thereafter. The inventors of the present invention have therefore identified a need for an alternative anti-pucker apparatus which can be used with any sewing machine without the need for any synchronised connection therewith, and yet which eliminates, or at least ameliorates, the problem of seam pucker even when sewing with less expensive, lower quality threads.

SUMMARY

According to a first aspect of the present invention, there is provided an anti-puckering apparatus for forming, on a work piece, a line of stitching substantially free from puckering; the apparatus comprising:

(i) a base member for removable attachment to a sewing machine bed surface proximate a needle and a stitch formation zone;

(ii) a carrier member mounted on, and moveable relative to, the base member; and (iii) an endless row of flexible filamentary elements carried by the carrier member;

wherein the carrier member progressively moves subsets of filamentary elements into and out of a stitch formation zone during the formation of a line of stitching; the filamentary elements being presented across a stitch formation zone in advance of an intended line of stitching at an oblique angle relative to a sewing machine bed surface.

In the context of the present invention, the "stitch formation zone" may be interpreted as being the three-dimensional space above a workpiece which underlies a sewing machine presser foot. It will be appreciated that the presentment of filamentary elements across the stitch formation zone immediately in advance of a sewing machine needle causes the top thread of each stitch to be formed over the underlying filamentary elements. Consequently, the length of top thread required to form the upper part of each individual stitch is necessarily slightly increased. The amount of the additional length is dictated by the filamentary elements' physical characteristics, e.g. individual filament diameters and overall number of filamentary elements underlying each stitch. The width of each filamentary element is less than that of a stitch. Crucially though, it has been found that the angle of inclination of the filamentary elements relative to the underlying workpiece also has a surprising effect on the top thread length of each stitch, and hence a reduction in seam tension pucker.

Optionally, the upper and/or lower surface(s) of the base member is/are inclined at an oblique angle relative to a sewing machine bed surface.

The base member may conveniently be provided in the form of a sewing folder attachment. In one embodiment, the angle of inclination of the base member proximate the stitch formation zone dictates the angle of inclination at which the filamentary elements are presented onto the workpiece across the stitch formation zone. Therefore, different base members may be provided—e.g. as part of a kit—each having a different angle of inclination thus allowing a user to select the most appropriate one for the stitching task at hand.

Optionally, the oblique angle is between 5 and 20 degrees.

More preferably, the oblique angle is between 8 and 12 degrees.

Optionally, the carrier member is a disc or wheel rotationally mounted to the base member.

Optionally, the disc or wheel is mounted to the underside of the base member.

Optionally, the filamentary elements project radially beyond the peripheral edge of the disc or wheel.

The filamentary elements may be circular in cross section and formed from a synthetic material such as nylon. They may be arranged side by side in close proximity to one another. It will be appreciated that the disc or wheel is freely rotatable about its axis. Advancement of the workpiece—e.g. by a feed dog—through the stitch formation zone causes a formed stitch to move away from the disc or wheel axis. Consequently, the filamentary elements must retract from beneath the top thread of the stitch as it exits the stitch formation zone. The linear movement of the workpiece relative to the disc or wheel causes the latter to rotate thus ensuring that new filamentary elements enter the stitch formation zone as the previous ones exit the stitch formation zone.

Optionally, the disc or wheel rotates about a non-vertical axis.

It will be appreciated that if the angle of inclination of the base member is matched to the desired oblique of the filamentary elements then the axis of the disc or wheel may extend perpendicularly relative to the base member's inclined surface.

Optionally, the distance between a peripheral edge of the base member proximate the stitch formation zone and the disc or wheel axis is less than the radius of the disc or wheel as measured from its axis to the outer extremities of its filamentary elements.

It will be appreciated that this positional arrangement of the disc or wheel on the base member allows at least the distal ends of the filamentary elements to extend past the peripheral edge of the base member during the part of their rotational path in which they enter and exit the stitch formation zone beneath the presser foot.

According to a second aspect of the present invention, there is provided a sewing machine comprising an anti-puckering apparatus according to the first aspect.

Optionally, the base member is slidably mounted on the sewing machine bed surface.

Optionally, a protrusion on, or attachable to, the sewing machine bed surface is engagable with a slot formed in the base member.

As noted above, the presence of filamentary elements across the stitch formation zone causes the length of thread required to form the upper part of each individual stitch to be increased relative to that required to that required to form the lower part of each individual stitch. The additional length is consistent with the overall number and diameter of filamentary elements underlying each stitch (and may be affected by other characteristics, including filament stiffness). Therefore, different carrier members (or indeed different base members incorporating different carrier members) may be provided—e.g. as part of a kit—each having different filament characteristics. For example, different base members or different carriers may be provided having different filament diameters, filament material, filament density (i.e. number of individual filaments per unit area), filament length, filament stiffness etc. A user may therefore select the most appropriate filament type for the stitching task at hand.

According to a third aspect of the present invention, there is provided an anti-puckering kit comprising a plurality of apparatuses of the first aspect, each having differing oblique angles and/or different filament characteristics

BRIEF DESCRIPTION OF THE DRAWINGS

Embodiments of the invention will now be described, by way of example only, with reference to the accompanying drawings, in which.

DETAILED DESCRIPTION

Figure 1:
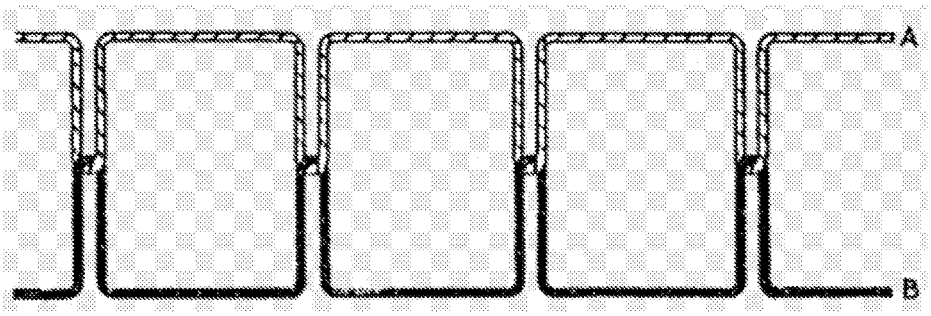
FIG. 1 is a schematic cross-sectional representation of a line of stitching of the "lock stitch" type.

FIG. 1 is a schematic cross-sectional representation of upper and lower threads (A, B) forming a "lock stitch" through a workpiece. The lock stitch is formed by extending the upper thread (A) through the workpiece by a needle, and interconnecting it with the lower thread (B) supplied by a bobbin beneath the sewing machine bed. As the needle and the upper thread are withdrawn the two threads (A, B) lock within the workpiece. When the upper and lower threads are balanced, there is a substantially equal thread length within each stitch above and below the point of interconnection. Any imbalance in the stitch can manifest itself in a puckered appearance along a line of stitching.

Figure 2A:
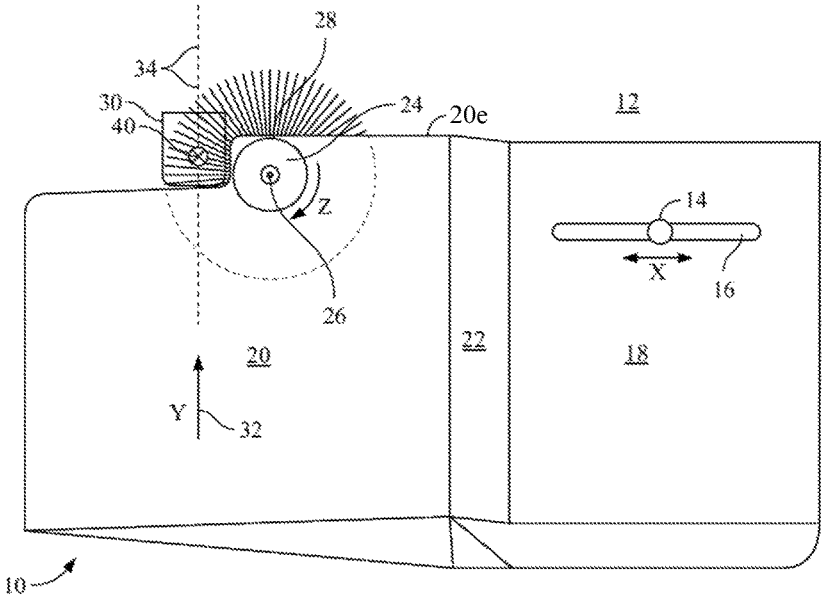
FIG. 2A is a schematic plan view of an anti-puckering accessory for a sewing machine according to a first embodiment, in the form of a sewing folder comprising a disc or wheel of filamentary elements.
Figure 2B:
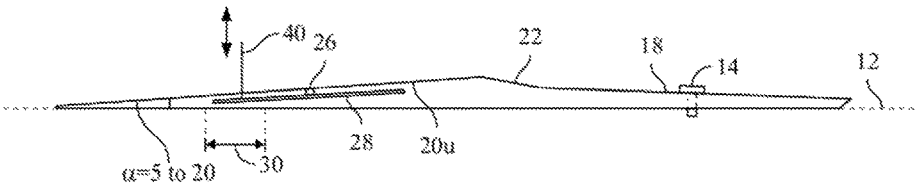
FIG. 2B is a schematic cross-sectional side representation of the anti-puckering accessory of FIG. 2A.

FIGS. 2*a* and 2*b* show a sewing folder attachment 10 according to a first embodiment which is removably attachable to a sewing machine bed 12 by means of a protruding fastener 14 within the latter receivable within an elongate slot 16 provided in the former. It will be appreciated that a user may selectively loosen the fastener 14 and move the sewing folder sewing folder attachment 10 attachment 10 laterally as indicted by arrow X before tightening the fastener 14 to secure the attachment at a desired lateral position relative to the underlying sewing machine bed 12. The sewing folder attachment 10 may be formed from a durable material such as a metal or plastics material. Alternatively, the sewing folder attachment 10 may be formed from a stiff card.

The elongate slot 16 is formed in a primary surface 18 at the right side of the sewing folder attachment 10 as shown in FIG. 2*a*. The primary surface 18 is substantially horizontal in use. A secondary surface 20 forms the left side of the sewing folder attachment 10 as shown in FIG. 2*a*. The primary and secondary surfaces 18, 20 are separated by a transition surface 22. For the reasons explained further below, the secondary surface 20 is inclined, in use, relative to the underlying sewing machine bed 12 at an angle $\alpha$ which may be in the range of 5 to 20 degrees (or more preferably, 8 to 12 degrees). The transition surface 22 connected the elevated right hand edge of the secondary surface 20 to the lower left hand edge of the primary surface 18.

A carrier member in the form of a wheel 24 is attached about an axis of rotation 26 to the underside 20*u* of the secondary surface 20 which is also inclined at an angle $\alpha$ relative to the underlying sewing machine bed 12. A plurality of flexible filaments or fibres 28 extend radially from the wheel 24 in a plane which extends substantially perpendicularly relative to the axis of rotation 26. As is evident from FIG. 2*a*, the distance between the axis of rotation 26 and the nearest edge 20*e* of the secondary surface 20 is less than the radius of the wheel 24 as measured from its axis of rotation 26 to the outermost distal ends of the flexible filaments or fibres 28. Consequently, the flexible filaments or fibres 28 project beyond the edge 20*e* into a stitch formation zone 30 interposed between a workpiece to be sewn (not shown) and a sewing machine presser foot (not shown). In one example, the radius of the wheel is 30 mm.

As a consequence of the angle of inclination of the underside 20*u* of the secondary surface 20, the flexible filaments or fibres 28 are introduced into the stitch formation zone 30 at an angle α relative a workpiece to be sewn, as shown in FIG. 2*b*. This has been found to be surprisingly advantageous in terms of eliminating, or at least reducing, seam tension pucker.

Figure 3:
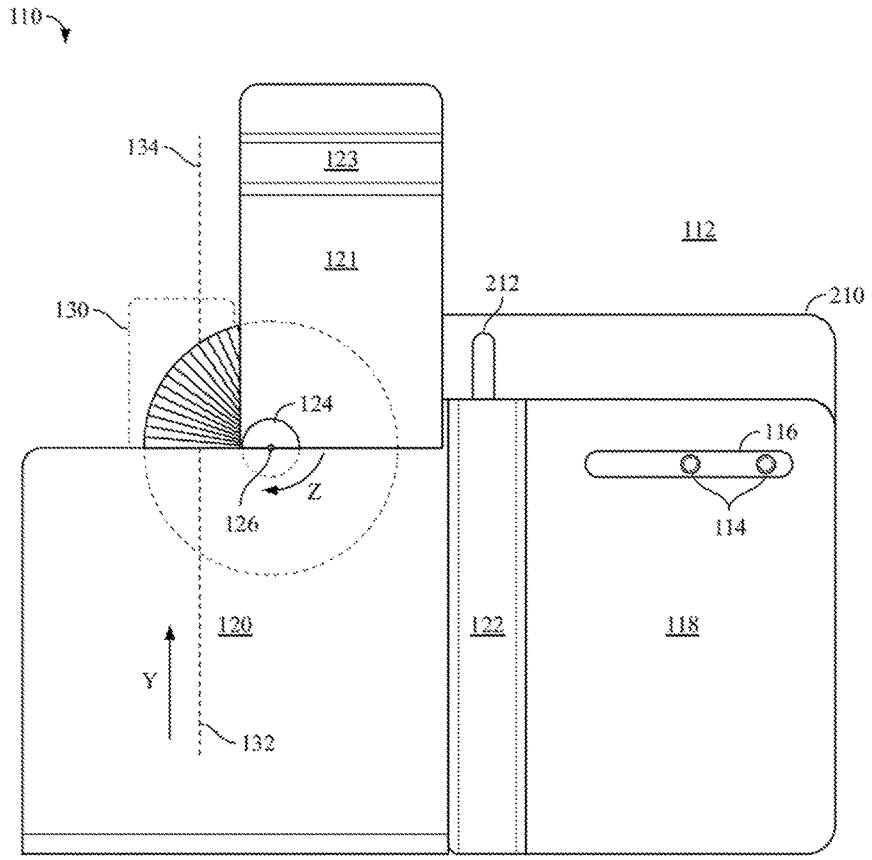
FIG. 3 is a schematic plan view of an anti-puckering accessory for a sewing machine according to a second embodiment, in the form of a sewing folder comprising a disc or wheel of filamentary elements.

FIG. 3 shows a sewing folder attachment 110 according to a second embodiment which has many features in common with the sewing folder attachment 10 according to the first embodiment as described above. In order to minimise repetition, features in FIG. 3 are numbered with a common two-digit reference numeral and are differentiated by a third digit placed before the two common digits. Such features are structured similarly, operate similarly, and/or have similar functions as previously described unless otherwise indicated.

The sewing folder attachment 110 of FIG. 3 differs from that of FIG. 2*a* in two main respects.

Figure 5:
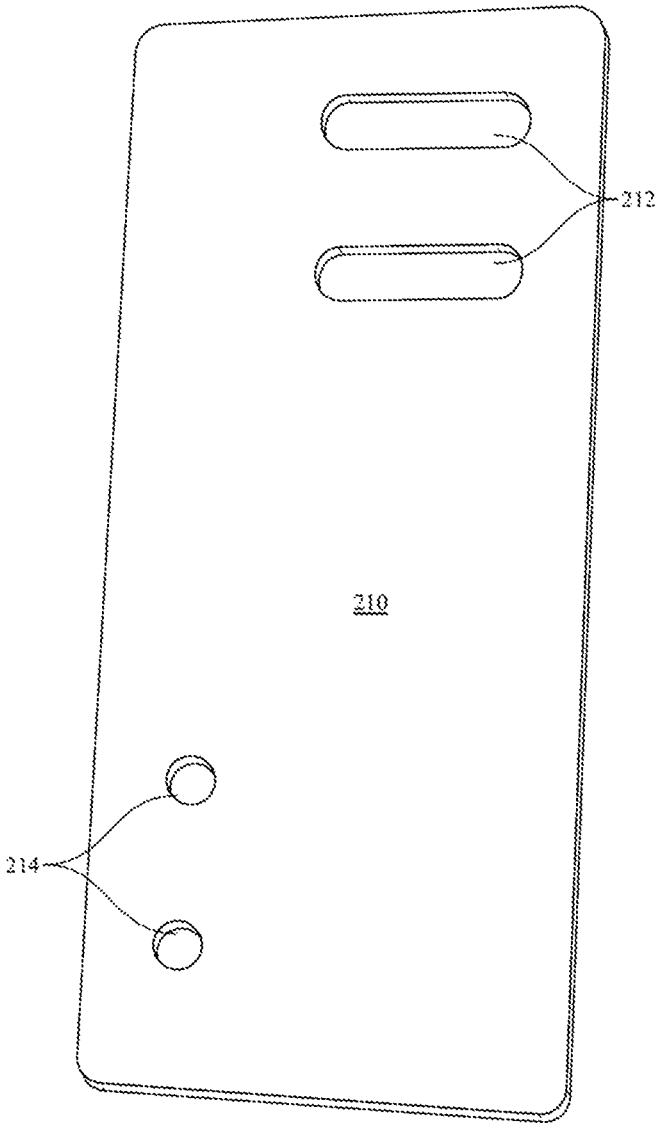
FIG. 5 is a schematic plan view of an intermediate plate member overlying a sewing machine bed surface, and underlying the sewing folder of the first or second embodiment.

Firstly, instead of protruding directly from the sewing machine bed 112, two fasteners 114 are attachable to an underlying intermediate plate member 210 as shown in FIG. 5. In one embodiment, the intermediate plate member 210 is generally rectangular in shape and measures 40 mm by 95 mm. It is provided with two elongate parallel slots 212 and two apertures 214 spaced apart from said slots 212. The intermediate plate member 210 is attachable to the sewing machine bed 112 via fasteners extendable through one of the slots 212 into an aperture (not shown) provided at a fixed position on the sewing machine bed 112.

It will therefore be appreciated that there is a degree of flexibility in terms of the position of the intermediate plate member 210—and its two apertures 214—on the sewing machine bed 112. The fasteners 114 extend through the slot 116 in the primary surface 118 of the sewing folder attachment 110 into one or both of the apertures 214 in the intermediate plate member 210. The intermediate plate member 210 therefore acts a guide member for guiding the sewing folder attachment 10, 110 of the first or second embodiment during its lateral slidable movement relative to the underlying sewing machine bed surface 112.

Secondly, an extension member 121 extends integrally from the secondary surface 120 generally above and to the right of the stitch formation zone 130 as viewed in FIG. 3. A transition surface 123 inclines downwardly towards the sewing machine bed 112 towards the upper end of the extension member 121. The extension member 121 overlies and supports a workpiece (not shown) as it is moved downstream of the stitch formation zone 130, and may serve a means of visually aligning the workpiece relative to the wheel 124 as it is moved in the Y-direction. By providing support from above, the extension member 121 promotes a smoother movement of the workpiece in the Y-direction within the stitch formation zone 130, thus improving stitching quality.

Figure 4:
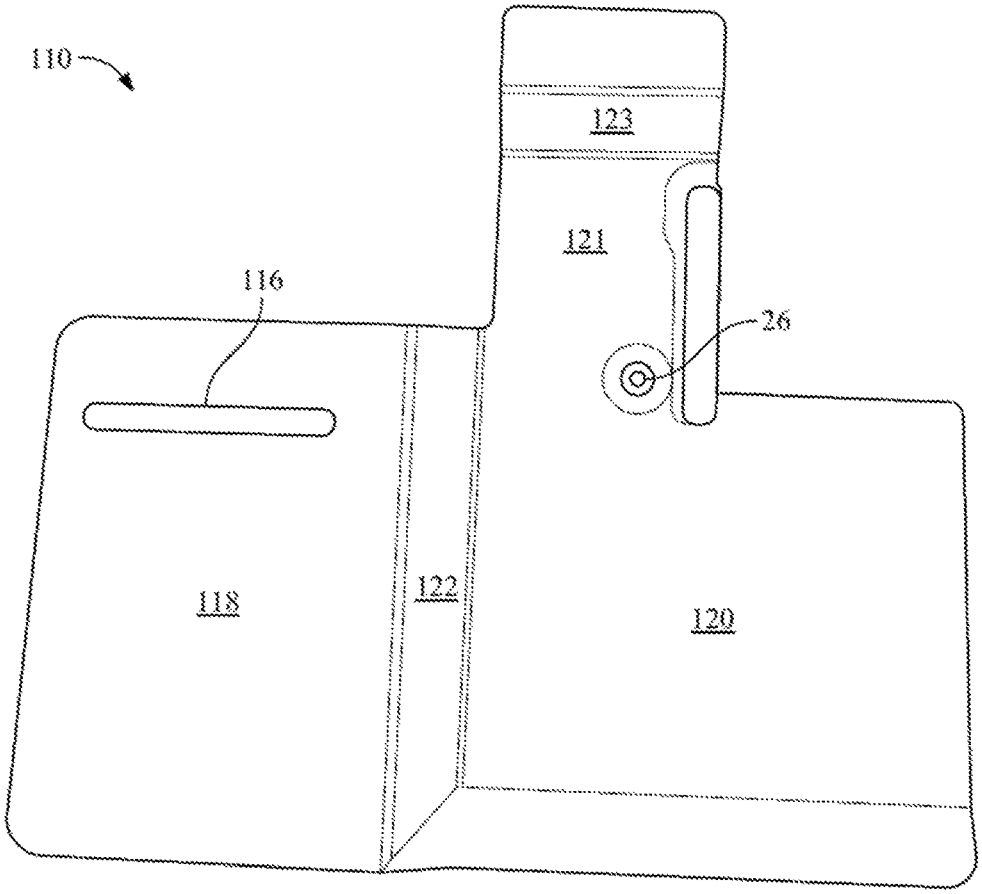
FIG. 4 is a schematic underside view of the sewing folder shown in FIG. 5 without its disc or wheel of filamentary elements.

FIG. 4 is a schematic underside view of the sewing folder attachment 110 shown in FIG. 3, but without the wheel 124.

In use, a user places a workpiece to be sewn on the sewing machine bed 12, 112 proximate the stitch formation zone 30, 130. The sewing folder attachment 10, 110 is then moved laterally from right to left to until the flexible filaments or fibres 28, 128 extend into the stitch formation zone 30, 130 across an intended line of stitching 32, 132. Once correct lateral positioning is achieved the fastener(s) 14, 114 is/are tightened within the slot 16, 116 to lock the primary surface 18, 118 (and hence the entire sewing folder attachment 10, 110) relative to the sewing machine bed 12, 112.

When sewing commences, a workpiece is translated in a direction indicated by arrow Y in FIGS. 2*a* and 3. The workpiece moves into the stitch formation zone 30, 130 below the flexible filaments or fibres 28, 128. A sewing machine needle 40, 140 penetrates the workpiece between the flexible filaments or fibres 28, 128 to thereby create stitches 34, 134 within the stitch formation zone 30, 130. The continual presence of flexible filaments or fibres 28, 128 within the stitch formation zone 30, 130 means that the top thread of individual stitches 34, 134 is formed over the underlying flexible filaments or fibres 28, 128. Consequently, the length of the top thread in each individual stitch is increased relative to the corresponding bottom thread as described below with reference to FIG. 6.

As a workpiece is advanced in the direction indicated by arrow Y, newly formed stitches 34, 134 exit the stitch formation zone 30, 130. As they do so, their distance of separation from the rotational axis 26, 126 of the wheel 24, 124 increases causing the flexible filaments or fibres 28, 128 to be withdrawn from the position underlying the top thread of each stitch 34, 134. The progressive linear movement of the workpiece therefore causes the wheel 24, 124 to rotate in a clockwise direction as indicated by arrow Z in FIGS. 2*a* and 3. Rotation of the wheel 24, 124 continuously introduces new flexible filaments or fibres 28, 128 into the stitch formation zone 30, 130 to replace those being withdrawn from newly formed stitches 34, 134.

Figure 6:
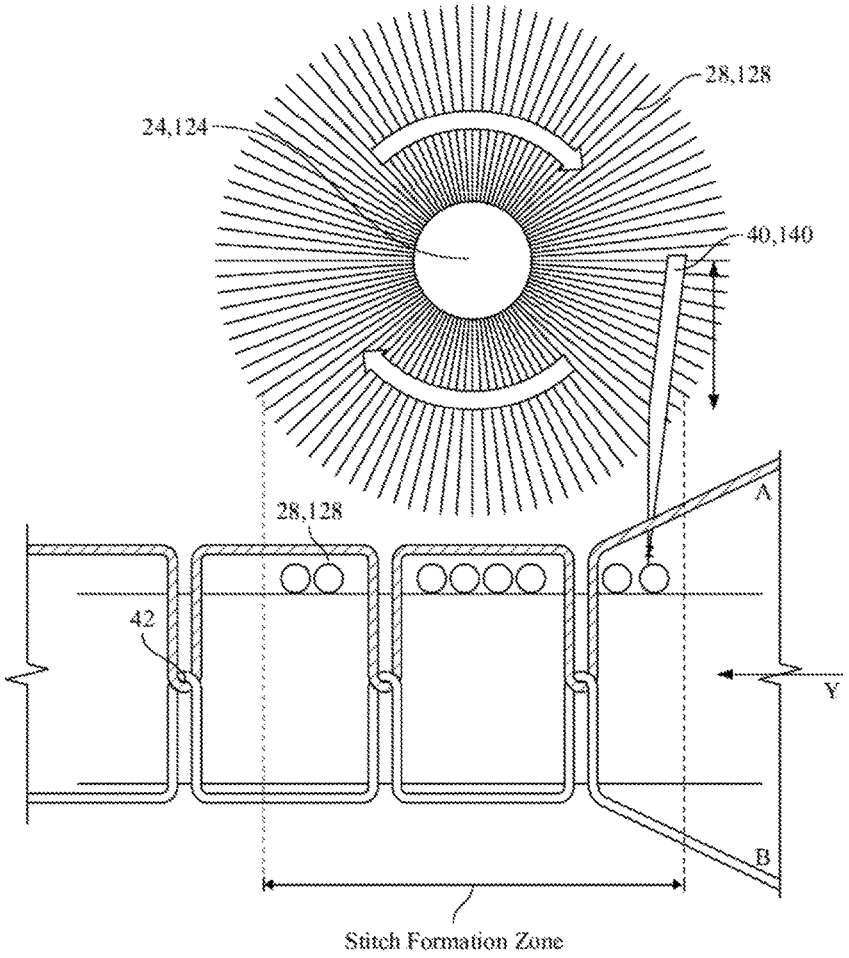
FIG. 6 is a schematic cross-sectional side representation corresponding to that of FIG. 1 wherein filamentary elements underlie the upper thread.

FIG. 6 is a schematic cross-sectional representation of upper and lower threads A, B forming a "lock stitch" through a workpiece. The lock stitch is formed in the manner already described above with reference to FIG. 1. However, as described above with reference to FIGS. 2*a*,2*b* and 3, the upper thread A within each stitch is formed over a group of underlying flexible filaments or fibres 28, 128 thereby increasing its length between adjacent points of interconnection 42. In order to aid understanding, the relative position of the wheel 24, 124 is also shown in FIG. 6 above cross-sectional representation of upper and lower threads A, B.

FIG. 5 is also a schematic cross-sectional representation of upper and lower threads (A, B) forming a "lock stitch" through a workpiece. The lock stitch is formed in the manner already described above with reference to FIG. 1. However, the upper thread (A) within each stitch is formed over a group of underlying flexible filamentary elements thereby increasing its length between adjacent points of interconnection.

It will be appreciated that the sewing folder attachment 10, 110 of the present invention can be quickly and easily attached to a sewing machine bed 12, 112. By retrofitting the sewing folder attachment 10 to existing domestic or industrial sewing machines, a user is provided with a flexible and cost-effective solution to the problem seam tension pucker. Indeed, a range of different sewing folder attachments 10, 110 may be provided—e.g. as part of a kit—each providing different technical characteristics suitable for differing sewing tasks or materials. For example, different sewing folder attachments 10, 110 may be provided having different types, sizes, or numbers of flexible filaments or fibres 28, 128 on their respective wheels 24, 124; and/or having flexible filaments or fibres 28, 128 presented at a range of different oblique angles relative to the sewing machine bed 12, 112. Although not illustrated, the transition surface 22, 122 of the sewing folder attachment 10, 110 may be provided with hinged edges which can be locked in selected positions, thus providing a means of altering the angle α at which the flexible filaments or fibres 28, 128 extend relative to a workpiece.

Advantageously, by increasing the length of the top thread within each stitch 34, 134, the present invention facilitates the use of lower quality threads whilst avoiding or reducing the risk of seam tension pucker normally associated with these cheaper thread types. More specifically, even if the top thread "relaxes" or contracts following stitch formation, there is sufficient "slack" in the stitch to avoid the formation of pucker. However, the amount of additional length in the top thread is arranged to be small enough not to adversely affect the structural performance or aesthetics of a stitch irrespective of any shrinkage that may or may not occur. Accordingly, by using the anti-pucker apparatus of the present invention, the material costs associated with manufacturing textile products can be reduced with no, or at least minimal, compromise on the quality of stitching.

Further modifications and improvements may be made to foregoing without departing from the scope of the invention as defined by the accompanying claims. For example, whilst the illustrated and described embodiment comprises a base member the upper and/or lower surface(s) of which is/are inclined at an oblique angle relative to a sewing machine bed surface, alternative means of inclining the filamentary elements are not excluded. By way of example only, the disc or wheel to which the filamentary elements are attached may, instead of being arranged at a fixed angle with respect to the base member, be pivotable with respect to a non-inclined surface of the base member.

In summary, the invention relates to an anti-puckering apparatus for forming, on a work piece, a line of stitching substantially free from puckering. The apparatus comprises a base member (10) for removable attachment to a sewing machine bed surface (12) proximate a needle (40) and a stitch formation zone (30). A wheel (24) carrying an endless row of flexible filamentary elements (28) is mounted on, and rotatable relative to, an inclined surface (20*u*) of the base member. In use, the wheel (24) progressively moves subsets of filamentary elements (28) into and out of the stitch formation zone (30) during the formation of a line of stitching (34). The filamentary elements (28) are presented across the stitch formation zone (30) in advance of an intended line of stitching (32) at an oblique angle (α) relative to the sewing machine bed surface (12). The presence of the filamentary elements (28) across the stitch formation zone (30) causes the length of thread (A) required to form the upper part of each individual stitch to be increased relative to that required to that required to form the lower part of each individual stitch and hence a reduction in seam tension pucker.

The invention claimed is:

1. An anti-puckering apparatus for forming, on a work piece, a line of stitching substantially free from puckering; the apparatus comprising:

(i) a base member for removable attachment to a sewing machine bed surface proximate a needle and a stitch formation zone, wherein upper and/or lower surfaces of the base member are inclined at an oblique angle relative to a sewing machine bed surface, and the angle of inclination of the upper and/or lower surfaces of the base member base proximate the stitch formation zone dictates the angle of inclination at which the filamentary elements are presented onto the workpiece across the stitch formation zone;

(ii) a carrier member mounted on, and moveable relative to, the base member; and (iii) an endless row of flexible filamentary elements carried by the carrier member;

wherein the carrier member progressively moves subsets of filamentary elements into and out of a stitch formation zone during the formation of a line of stitching; the filamentary elements being presented across a stitch formation zone in advance of an intended line of stitching at an oblique angle relative to a sewing machine bed surface.

2. An anti-puckering apparatus for forming, on a work piece, a line of stitching substantially free from puckering; the apparatus comprising:

(i) a base member for removable attachment to a sewing machine bed surface proximate a needle and a stitch formation zone;

(ii) a carrier member mounted on, and moveable relative to, the base member; and (iii) an endless row of flexible filamentary elements carried by the carrier member;

wherein the carrier member progressively moves subsets of filamentary elements into and out of a stitch formation zone during the formation of a line of stitching; the filamentary elements being presented across a stitch formation zone in advance of an intended line of stitching at an oblique angle relative to a sewing machine bed surface, wherein the base member is a sewing folder attachment.

3. An anti-puckering apparatus according to claim 1, wherein the oblique angle is between 5 and 20 degrees.

4. An anti-puckering apparatus according to claim 1, wherein the oblique angle is between 8 and 12 degrees.

5. An anti-puckering apparatus according to claim 1, wherein the carrier member is a disc or wheel rotationally mounted to the base member.

6. An anti-puckering apparatus according to claim 5, wherein the disc or wheel is mounted to an underside of the base member.

7. An anti-puckering apparatus according to claim 5, wherein the filamentary elements project radially beyond the peripheral edge of the disc or wheel.

8. An anti-puckering apparatus according to claim 1, wherein the filamentary elements are circular in cross section and arranged side by side in close proximity to one another.

9. A sewing machine comprising an anti-puckering apparatus wherein the anti-puckering apparatus comprises:

(i) a base member for removable attachment to a sewing machine bed surface proximate a needle and a stitch formation zone;

(ii) a carrier member mounted on, and moveable relative to, the base member; and (iii) an endless row of flexible filamentary elements carried by the carrier member;

wherein the carrier member progressively moves subsets of filamentary elements into and out of a stitch formation zone during the formation of a line of stitching; the filamentary elements being presented across a stitch formation zone in advance of an intended line of stitching at an oblique angle relative to a sewing machine bed surface, wherein the base member is slidably mountable on the sewing machine bed surface.

10. An anti-puckering kit comprising a plurality of apparatuses according to claim 1, each having differing oblique angles and/or different filament characteristics.

* * * * *